US005822835A

United States Patent [19]

Dischler

[11] Patent Number: 5,822,835

[45] Date of Patent: Oct. 20, 1998

[54] METHOD AND APPARATUS FOR WEB TREATMENT

[75] Inventor: Louis Dischler, Spartanurg, S.C.

[73] Assignee: Milliken Research Corporation, Spartanburg, S.C.

[21] Appl. No.: 999,638

[22] Filed: Sep. 17, 1997

Related U.S. Application Data

[60] Provisional application No. 60/027,244, Oct. 2, 1996.

[51] Int. Cl.[6] ..... D06C 19/00

[52] U.S. Cl. ..... 28/167; 26/1; 26/18.5; 68/5 D; 34/465

[58] Field of Search ..... 26/1, 18.5, 18.6, 26/51, 99, 74; 28/165, 167, 155; 34/459, 460, 462, 463, 465, 629; 68/5 R, 6, 7, 8, 5 B, 5 C, 5 D; 15/309.1

[56] References Cited

U.S. PATENT DOCUMENTS

| | | | |
|---|---|---|---|
| 300,964 | 6/1884 | Garnier . | |
| 392,082 | 10/1888 | Turner . | |
| 502,903 | 8/1893 | Fries . | |
| 2,730,786 | 1/1956 | Kindstrand et al. | 26/1 |
| 2,740,202 | 4/1956 | Fowle | 34/18 |
| 2,972,177 | 2/1961 | Bidgood, Jr. | 26/1 |
| 3,078,496 | 2/1963 | Doran et al. | 15/346 |
| 3,775,806 | 12/1973 | Olbrant et al. | 15/306 A |
| 3,925,865 | 12/1975 | Christian | 26/18.5 |
| 4,055,003 | 10/1977 | Sack | 34/155 |
| 4,121,311 | 10/1978 | Meyer | 68/5 D |
| 4,236,391 | 12/1980 | Stobi | 68/5 D |
| 4,286,395 | 9/1981 | Hoersch | 34/155 |
| 4,345,385 | 8/1982 | Sando et al. | 34/23 |
| 4,409,709 | 10/1983 | Sando et al. | 28/155 |
| 4,575,952 | 3/1986 | Bodenan et al. | 34/54 |
| 4,837,902 | 6/1989 | Dischler | 26/1 |
| 4,918,795 | 4/1990 | Dischler | 26/1 |
| 5,274,892 | 1/1994 | Strahm | 26/18.5 |

FOREIGN PATENT DOCUMENTS

| | | |
|---|---|---|
| 0012731 | 6/1980 | European Pat. Off. . |
| 662640 | 5/1979 | U.S.S.R. . |
| 711210 | 1/1980 | U.S.S.R. . |
| 595444 | 10/1981 | U.S.S.R. . |
| 1252411 | 8/1986 | U.S.S.R. . |

*Primary Examiner*—Amy Vanatta
*Attorney, Agent, or Firm*—Terry T. Moyer; William S. Parks

[57] ABSTRACT

A process for treatment of a web by means of impingement by high velocity gaseous fluid is provided. The process constitutes the provision of a web to two separate treatment zones. In the first treatment zone the web is subjected to the imposition of high velocity gaseous fluid substantially tangential to the web and in the opposite direction of travel by the web through the treatment zone, such that a series of saw-tooth waves are formed in and move along the web in the opposite direction of travel by the web. In the second conditioning zone, the same type imposition of high velocity gaseous fluid to the web occurs with the gas streams and the resultant saw-tooth waves forced in the same direction as the travel of the web. The two zones are separated by an area of high tension on the web. An apparatus for carrying out the process is also provided.

4 Claims, 3 Drawing Sheets

*FIG. –1–*

METHOD AND APPARATUS FOR WEB TREATMENT

This application is based upon pending United States Provisional Application 60/027,244, filed Oct. 2, 1996.

FIELD OF THE INVENTION

The present invention relates generally to a method and apparatus for softening and conditioning a web of fabric by vibrating the web by means of two zones of pneumatically excited saw-toothed waves which work and condition the fabric while imparting substantially no net tension to the web. In the first zone, a low pressure stream of gas directed at near-sonic velocity between the fabric and a rigid plate causes vibrations in the opposite direction as travel by the web. In the second zone, a low pressure stream of gas directed at near-sonic velocity between the fabric and a rigid plate causes vibrations in the same direction as travel by the web. An area of high tension on the web separates the first zone from the second zone.

BACKGROUND OF THE INVENTION

Materials such as fabrics are characterized by a wide variety of functional and aesthetic characteristics. Of those characteristics, a particularly important feature is fabric surface feel or "hand." The significance of a favorable hand in a fabric is described and explained in my U.S. Pat. Nos. 4,918,795, issued Apr. 24, 1990, and 4,837,902, issued Jun. 13, 1989, the teachings of which are both incorporated herein by reference.

A favorable hand characteristic of a fabric is usually obtained subsequent to its finishing (i.e., dyeing, decorating, texturing, etc.). The conditioning of a fabric after finishing is difficult to accomplish due to the fragile nature of the fabric and the ease of mark-off of any dyes, pigments, or other decorative accoutrements. Prior methods of fabric conditioning after finishing have included roughening of the finished product with textured rolls or pads. These methods, as mentioned above, may be destructive to the finished fabric due to the problem of mark-off. Thus, a process in which no contact with rough surfaces is necessary which provides optimal levels of softening and conditioning of such a fabric with limited damage to the already finished product.

My previous patents, as well as pending application Ser. No. 08/593,670, filed Jan. 29, 1996, have identified techniques for conditioning textile sheets to change their aesthetic qualities. Specifically, these patents disclose methods and equipment for projecting low pressure, high velocity streams of gaseous fluid against a fabric web in either the opposite or same direction substantially tangential to the web of fabric, thereby creating saw-tooth waves having small bending radii which travel down the fabric thereby breaking up fiber-to-fiber bonds in the web so as to increase drape and flexibility.

It has been found that some crease-sensitive webs cannot be processed by the technique disclosed and taught in my previous patents without the formation of objectionable longitudinal creases. These creases occur when fabric passes from a high tension region into a lower tension. Recovery of width at the lower tension causes creases to form near the origin of the air stream and propagate back into the high tension region, becoming more severe with distance into the high tension region. Fabrics sensitive to such creases are typically stretchy, exhibiting relatively low tensile strength modulus in the warp direction. These creases may result in permanent defects as thy are set in by the high temperature of the gas stream or ironed in by contact with an idler or opening roll.

It has been found that treatment of fabric with pneumatically induced saw-toothed waves is an effective and generally trouble free method of conditioning and softening webs of fabric. As the conditioning occurs without touching the fabric, minimal problems and off-quality occur due to mark-off, scuffing, cracking, and other problems associated with other softening processes. Interaction of the web with the air-stream does increase the tension of the web substantially along that portion of the web which lies up-stream of the direction of air flow. The tension may be several times that of the operating tension. Depending upon the elastic properties of the web in the web direction, instabilities may occur due to the sudden stretching of the web upon the sudden application or removal of the web to the stream. As the operating tension may be very low in order to achieve the highest possible softening effect, this instability may cause the web to veer to the side, fold over on itself, or otherwise get out of control. Further, the relatively long distance between the driven roll and the treatment area subject to high tension allows the web to neck in, which may result in a fabric which is either too narrow, or that has too much shrinkage. Second, if there are any defects in the fabric, such as tears, holes, or seams, the high tension may cause a break-out. These problems may occur where pneumatic pressure causes saw-toothed waves in either the same or opposite direction as the fabric travels.

Once maximum pressure and temperature are reached, and the process is running at the lowest practical tension, the only remaining method of achieving more softening effect is to slow down the web through-put speed. Slowing down the web is generally not economically feasible; instead, two units may be installed in-line so as to be able to run twice as fast with the same treatment level or to obtain higher treatment levels with the same web speed. This approach is deficient in several ways. First, two units are needed, with twice as many drives and tensions to be controlled, taking up more space and making the control of the web more difficult and complex. Second, the length of the fabric under high tension is doubled, and the tendency for the fabric to break-out is greatly increased as fabric defects which are further damaged by the first conditioning zone are much more likely to break-out in the second high tension zone.

It is therefore an object of this invention to supply a method and apparatus for high speed pneumatic conditioning of a fabric web of any width, but preferably 84 inches (about 2.14 meters) or less, by application of two treatment zones, the first zone with the air stream directed against the direction of web travel and the second zone, otherwise identical to the first, oriented with the direction of web travel and located immediately subsequent to the first zone. Application of air streams in opposition limits the formation of high tension to the short distance between the zones; this high tension being no higher than that occurring with the use of a single zone. In this way, twice the treatment is provided with only one set of drives and one tension control system, while minimizing the potential for stretching or narrowing of the web, and reducing the potential for break-outs. The high tension region between the two zones is preferably less than 20 inches (about 0.5 meters) and most preferably less than 10 inches (about 0.25 meters).

DETAILED DESCRIPTION OF THE DRAWING

Figure 1:
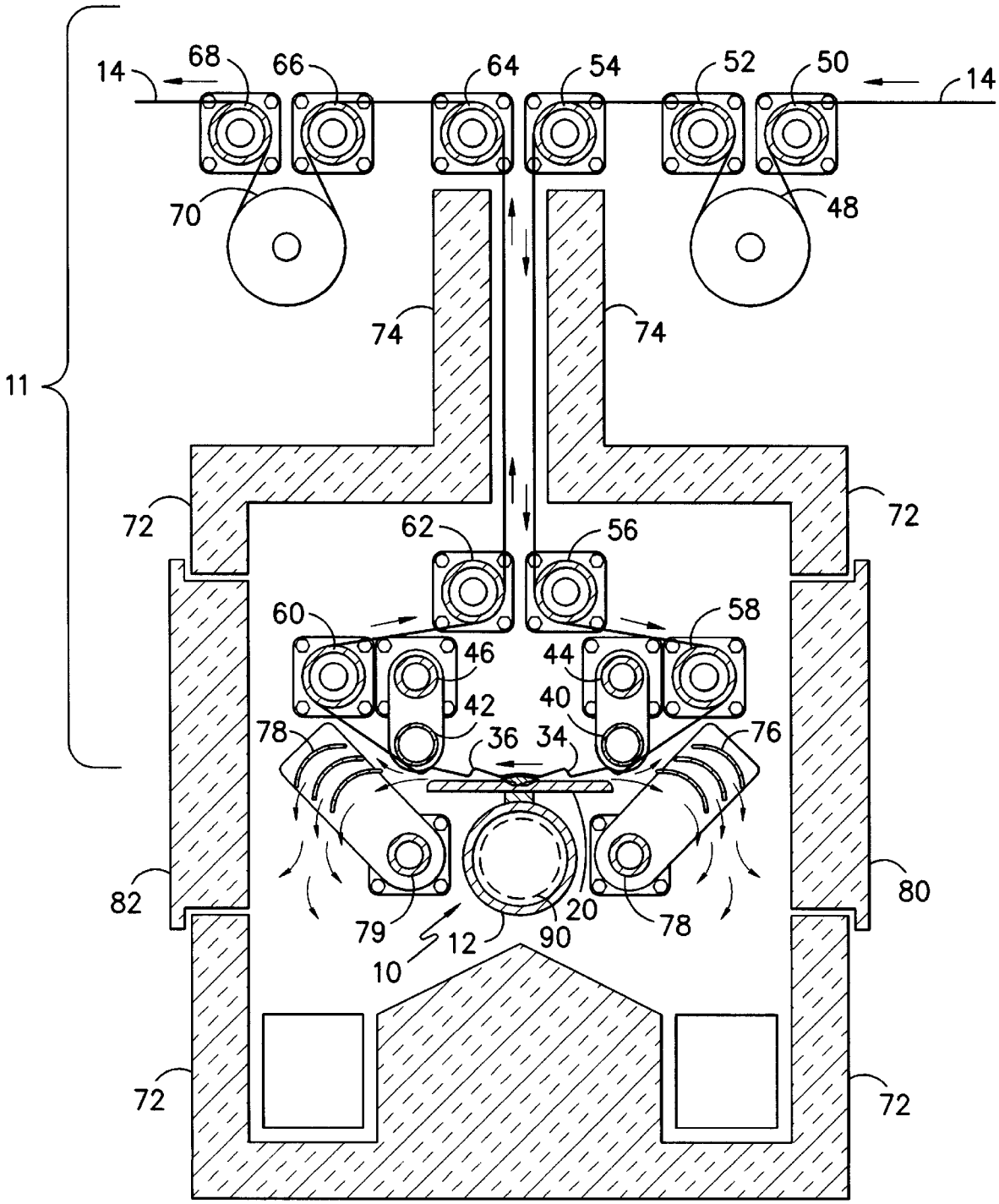
FIG. 1 is a schematic cross section of a machine according to a preferred embodiment of the present invention wherein the fabric web is in contact with both gas treatment streams.
Figure 2:
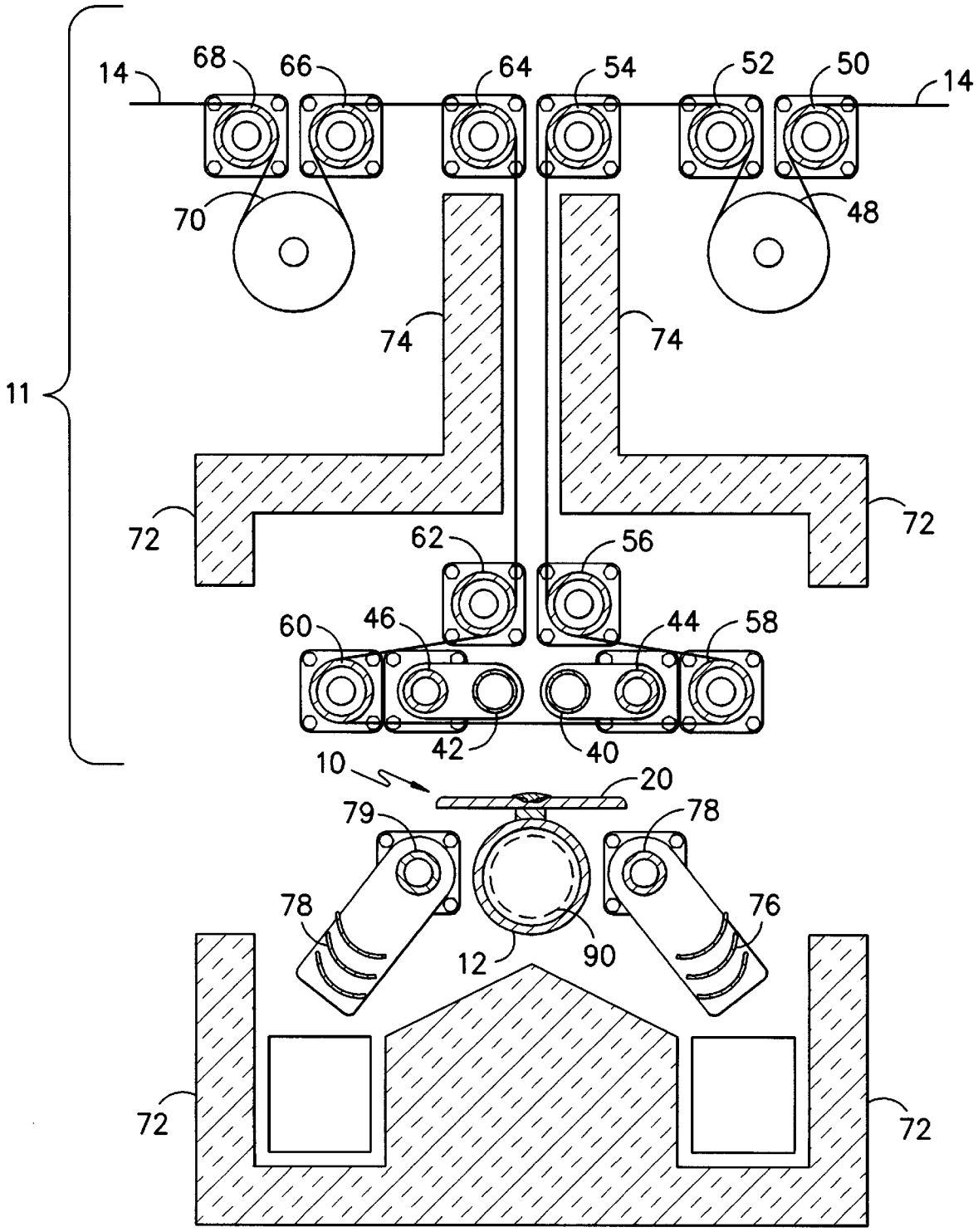
FIG. 2 is a schematic cross section of the machine of FIG. 1 with the fabric web removed from both gas treatment streams.
Figure 3:
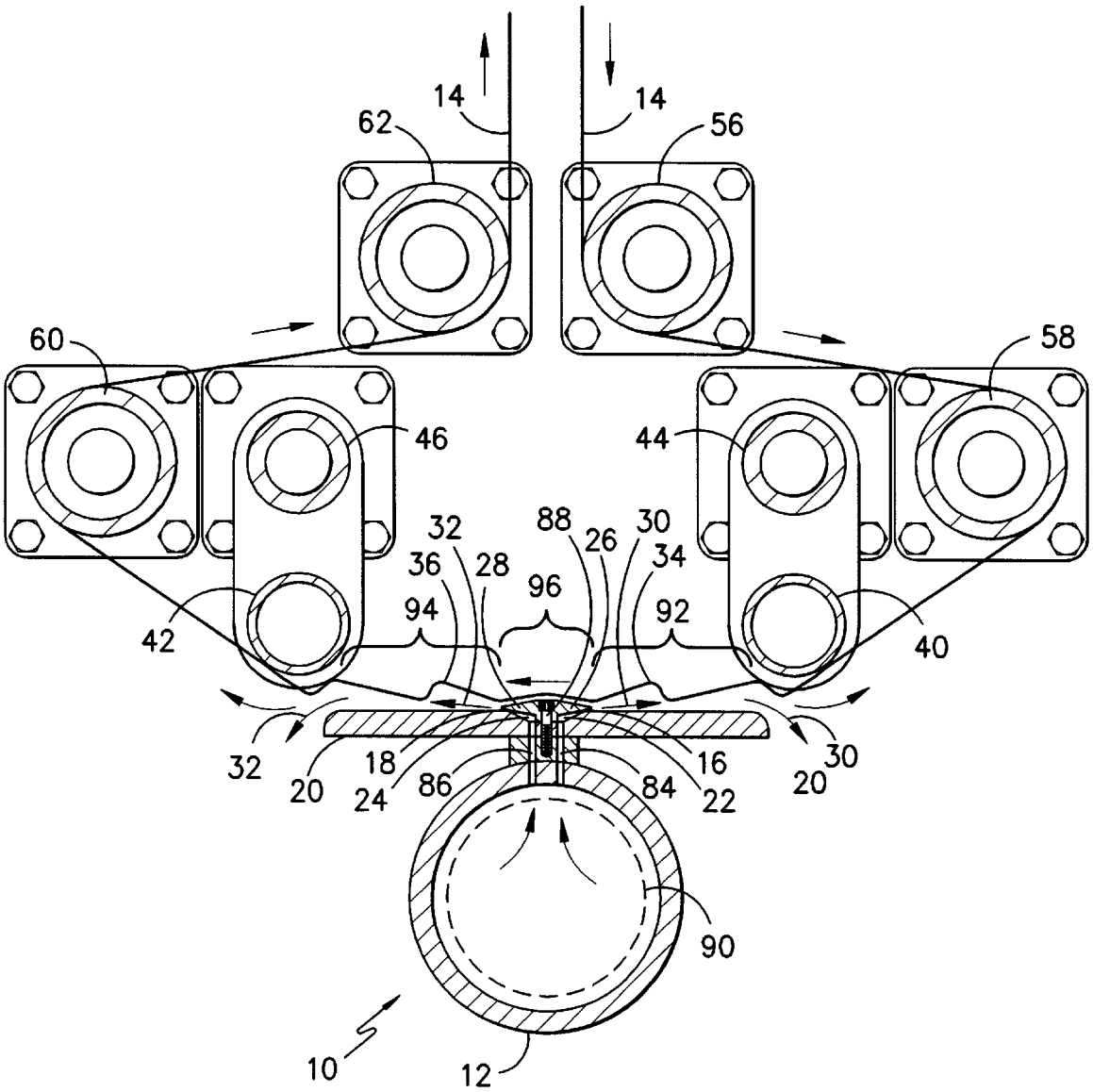
FIG. 3 is a cross section of a unified air manifold and treatment plate according to a preferred embodiment of the present wherein the fabric web is in contact with both gas treatment streams.

FIGS. 1, 2 and 3 all display an apparatus involving a potentially preferred practice of the present invention. As illustrated in FIGS. 1 and 2, this apparatus comprises an air jet assembly 10 and a web conveyor assembly 11. The air jet assembly 10 includes an air manifold 12 extending transverse to the direction of travel of a web 14. As shown in FIG. 3, the manifold supplies air or other gaseous fluid to converging diverging air nozzles 16, 18. These air nozzles 16, 18 direct low pressure, high velocity streams of gaseous fluid between the web 14 and an air deflector plate 20 in both opposite directions transverse to the plate 20. The air nozzles are comprised of the surfaces 22, 24 of the air deflector plate 20 and upper nozzle plates 26, 28 (which are actually the two opposing ends of one plate). As the web 14 passes over the air jet assembly 10 it interacts with the gas streams 30, 32 generated by the air nozzles 16, 18 first in the direction opposite the travel of the web 14 and then, subsequently, in the same direction of the web 14. In each of FIGS. 1, 2, and 3, this impingement by the gaseous fluid streams 30, 32 gives rise to the formation of two sets of juxtaposed saw-tooth waves 34, 36 in conditioning zones adjacent to the air nozzles 16, 18 separated by an area of high tension 38 in the web 14.

In FIGS. 1 and 2, the web 14 is brought into and out of contact with the gas treatment streams by the web conveyor assembly 11 by means of pivotable web deflection rolls 40, 42 through which the web 14 is threaded. These web deflection rolls 40, 42 are connected to rotating drums 44, 46 which turn about their axes at about ninety degrees in order to pivot the web deflection rolls 40, 40 into place just above the air deflection plate 20 on either side of the air nozzles 16, 18 (as illustrated in FIGS. 2 and 3). The web 14 is moved through the apparatus by the web conveyor assembly 11. The web 14 travels first around a first idler roll 50 and a first drive roll 48 which is utilized to adjust tension of the web 14. The web 14 then passes around a number of idler rolls 52, 54, 56 which monitor the tension of the web 14 through the utilization of load cells (not illustrated). Load cells measure the tension of the web 14 and can signal the drive roll 48 to keep the tension low in order to insure optimum performance. A web width opening roll 58, which is preferably a stainless steel scroll roll, removes any folds or creases in the web 14 in order to permit the maximum surface area of the web 14 to be conditioned by the low pressure gas streams.

Once the web 14 has been subjected to the gas streams, it passes through a subsequent web width opening roll 60 to insure the web 14 is not folded or creased. Idler rolls 62, 64, 66 deliver the web 14 to a further drive roll 70 which is utilized to both move the web 14 and adjust the tension of the web 14 when used in conjunction with first drive roll 48.

The entire air jet assembly 10 as well as the pivotable web deflection rolls 40, 42, rotating drums 44, 46, and web width opening rolls 58, 60 are located within a sound containment housing 72. This housing 72 aids in preventing the escape of potentially damaging acoustic energy created by the air jet assembly 10 during the web conditioning process. An acoustic tunnel 74 is also provided which allows introduction and exit of the web 14 into and out of the sound containment housing 72. The acoustic energy generated by the air manifold 12 is adsorbed by repeated reflections with the sides of the acoustic tunnel 74.

Air deflector vanes 76, 78 pivot downward for access and upward during normal operation. This pivoting is accomplished through the use of rotating drums 77, 79 which are connected to the deflector vanes 76, 78 and which turn about on their axes at about ninety degrees to move the deflector vanes 76, 78 in to position above and on either side of the air manifold 12. These deflector vanes 76, 78 deflect the air stream generated by the air jet assembly 10 downward into the sound containment housing 72 where the stream may further be deflected by other vanes (not illustrated) into an exhaust duct (not shown) exiting the sound containment housing 72. The housing 72 further provides access doors 80, 82 which, when closed, provide protection from the potentially harmful noise level and when opened allow access to the entire air jet assembly 10 as well as the pivotable web deflection rolls 40, 42, rotating drums 44, 46, and web width opening rolls 58, 60 for repairs or removal of fabric debris.

As noted above, FIG. 3 shows the preferred embodiment of the air jet assembly 10. The web 14 is brought into contact with the gas streams 30, 32 by the pivotable web deflector rolls 40, 42. The gas streams 30, 32 are supplied by the air manifold 12 which delivers air through two juxtaposed cylindrical openings 84, 86 leading outward. The gas streams 30, 32, after passing through a cylindrical screen filter 90, are forced out of the openings 84, 86 through air nozzles 40, 42 formed by the surfaces 22, 24 of the lower air deflector plate 20 and the upper nozzle plates 26, 28. The upper nozzles plates 26, 28 (which, again, is actually one plate) are held in place by a bolt 88. The gas streams 30, 32 exit the juxtaposed air nozzles 16, 18 between the web 14 and the air deflector plate 20. As a result, the gas streams 30, 32 produce saw-toothed waves 34, 36 in the web 14 in a first conditioning zone 92 in the opposite direction of the travel of the web 14, and a second conditioning zone 94 in the same direction of the travel of the web 14. A resultant area of high tension 96 between these conditioning zones 92, 94. The gas streams 30, 32 exit the air nozzles at a velocity of about M1 to M2 when supplied at 30 psi and 380 degrees fahrenheit. The overall tension of the web 14 prior to and subsequent to the treatment zones is preferably less than 1 pound per inch of fabric width.

It is to be noted that while the process of the present invention is believed to be particularly useful in the treatment of textile fabrics, such as cotton, polyester, blends of cotton and polyester, air bag fabrics, and the like, the practice is also believed to be applicable to materials other than traditional textile fabrics including polymeric films and laminated materials.

Some of those material webs which are sensitive to web narrowing when processed in the manner described in my U.S. Pat. Nos. 4,918,795 and 4,837,902 are believed to be characterized by relatively high elongation, i.e., low tensile modulus. When such a web is placed under high tension, such as that which occurs due to frictional interaction of the web with a high speed air stream, it will also narrow in the perpendicular direction. The sudden change in tension as the web exits the air stream allows the fabric width to recover to some degree, which can result in creases which may propagate back into the high tension region. Thus, it is advantageous to keep the high tension region as short as practical, which can be accomplished by the use of back to back air streams, with a relatively short distance between the origins thereof, in order to minimize the narrowing of the width, as well as to reduce the area in which creases develop, while also allowing higher levels of treatment with reduced chance of web damage or break.

In light of the above, it can be seen that the present invention provides a new and useful process of the treatment of materials which have heretofore been difficult to handle according to previous techniques. The present invention thereby provides a useful advancement over such previous technology.

While specific features of the invention have been described, it will be understood, of course, that the invention is not limited to any particular configuration or practice since modification may well be made and other embodiments of the principals of the invention will no doubt occur to those skilled in the art to which the invention pertains. Therefore, it is contemplated by the appended claims to cover any such modifications as incorporate the features of the invention within the true meaning, spirit, and scope of such claims.

What is claimed is:

1. A method for conditioning a crease sensitive web, comprising the steps of:

supplying a web to a first conditioning zone, wherein the web is treated by projecting at least one high velocity stream of gaseous fluid against only one side of the web substantially tangential to the path of travel of the web and in the opposite direction of travel of the web such that a series of saw-tooth waves are formed in and move along the web in the opposite direction of travel of the web;

supplying the web to a second conditioning zone, wherein the web is treated by projecting at least one high velocity stream of gaseous fluid against the same side of the web as in the first conditioning zone substantially tangential to the path of travel of the web and in the same direction of travel of the web such that a series of saw-tooth waves are formed in and move along the web in the same direction of travel of the web;

supplying the web to an area of high tension which separates said first conditioning zone from said second conditioning zone; and removing the web from said second conditioning zone.

2. The method as recited in claim 1 wherein the web comprises a single layer of textile fabric.

3. The method as in claim 1 wherein the web comprises a polymeric film.

4. An apparatus for the conditioning of a crease sensitive web, comprising:

means for providing travel to the web;

means for supplying a gaseous fluid to one side of the web which first creates saw-tooth waves in the web in the opposite direction of the travel of the web and second creates saw-tooth waves in the web in the same direction of the travel of the web, wherein an area of high tension of the web separates said first set of saw-tooth waves from said second set of saw-tooth waves; and means for removing the web from the apparatus.

* * * * *